United States Patent [19]

Chardon et al.

[11] Patent Number: 4,499,715

[45] Date of Patent: Feb. 19, 1985

[54] METHOD AND DEVICE FOR THE KNOT-FREE CONNECTION OF TWO THREADS

[75] Inventors: Manfred Chardon; Reinhard Mauries; Joachim Rohner; Heinz Zumfeld, all of Mönchen-Gladbach, Fed. Rep. of Germany

[73] Assignee: W. Schlafhorst & Co., Mönchen-Gladbach, Fed. Rep. of Germany

[21] Appl. No.: 453,879

[22] Filed: Dec. 27, 1982

[30] Foreign Application Priority Data

Dec. 24, 1981 [DE] Fed. Rep. of Germany ..... 3151270

[51] Int. Cl.[3] ..... D01H 15/00

[52] U.S. Cl. ..... 57/22; 57/261

[58] Field of Search ..... 57/22, 261, 263

[56] References Cited

U.S. PATENT DOCUMENTS

| | | | |
|---|---|---|---|
| 4,341,065 | 7/1982 | Baumgartner et al. | 57/22 |
| 4,386,494 | 6/1983 | Felix | 57/22 |
| 4,397,138 | 8/1983 | Rohner et al. | 57/22 |
| 4,406,115 | 9/1983 | Negaty-Hindi et al. | 57/22 |
| 4,407,117 | 8/1983 | Garnsworthy | 57/22 |
| 4,411,128 | 10/1983 | Mima | 57/22 X |

*Primary Examiner*—Donald Watkins

*Attorney, Agent, or Firm*—Herbert L. Lerner; Laurence A. Greenberg

[57] ABSTRACT

Method for the knot-free connection of two threads formed of textile fibers of limited length having at least one twisted fiber strand, including a splicing device for mutually tangling, intermixing and intertwining individual fibers of the two threads, which includes inserting the two threads coming from opposite sides into the splicing device, trimming the end of each thread to a predetermined distance from the splicing device, vibrating, loosening, combing and separating the thread ends into individual fibers, cleaning and spreading apart each thread end by blowing compressed air into the splicing device obliquely to the longitudinal direction of the individual fibers and by beating, pulling and tearing with mechanical and pneumatic stresses in direction toward the thread ends, withdrawing the prepared thread ends from opposite sides up to the splicing device, tangling, mixing and hooking the individual fibers of the two thread ends to each other to form a splice connecting the threads after setting the splicing device in operation, introducing a thread twist into the splice, and removing the connected threads from the splicing device, and a device for carrying out the method.

15 Claims, 14 Drawing Figures

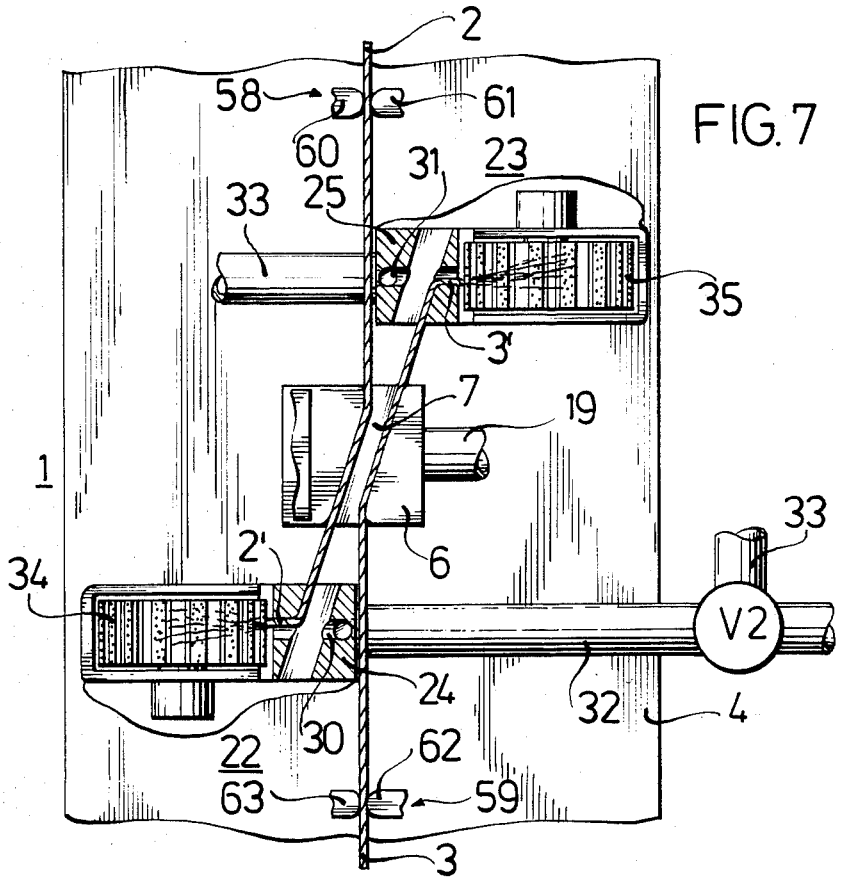
FIG. 7
FIG. 8
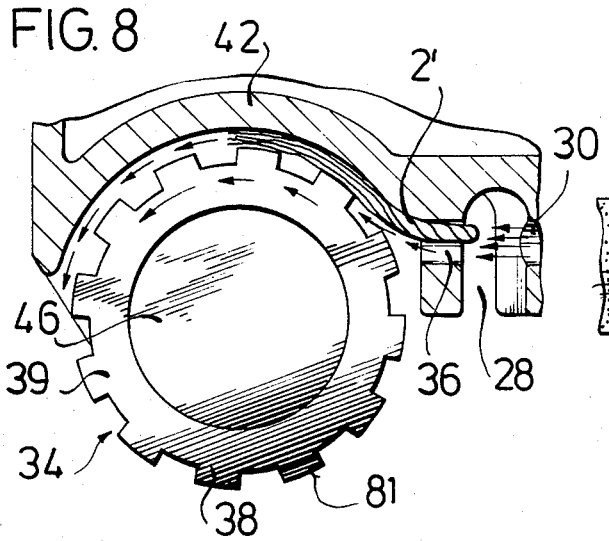
FIG. 9
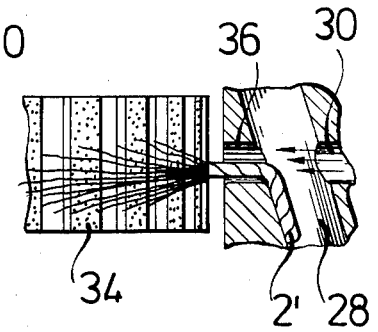

METHOD AND DEVICE FOR THE KNOT-FREE CONNECTION OF TWO THREADS

The invention relates to a method and a device for the knot-free connection of two threads being formed of textile fibers of limited length and having one or more twisted fiber strands, by means of a splicing device which tangles, intermixes and intertwines the individual fibers of the two threads with each other.

German Published, Non-Prosecuted Application DE-OS No. 28 10 741, the subject matter of which is included in U.S. Pat. No. 4,232,509, has disclosed a splicing method and a compressed air splicing device, wherein all factors which reduce the quality and depend on manual dexterity when making a splice, are to be eliminated. However, experience has shown that not all threads are equally suited for splicing. Most of all, strongly twisted threads, threads with several twisted fiber strands and yarns are difficult to splice, or cannot be spliced at all with the methods and devices known at present.

The invention is based on the recognition that before the actual splicing, the threads must be more intensively pretreated and prepared. Accordingly, it is an object of the invention to provide a method and device for the knot-free connection of two threads, which overcomes the hereinafore-mentioned disadvantages of the heretofore-known methods and devices of this general type, and to produce a good knot-free connection even with strongly twisted threads having several twisted fiber strands and with yarns.

With the foregoing and other objects in view there is provided, in accordance with the invention, a method for the knot-free connection of the threads formed of textile fibers of limited length having at least one twisted fiber strand, including a splicing device for mutually tangling, intermixing and intertwining individual fibers of the two threads, which comprises inserting the two threads coming from opposite sides into the splicing device, trimming the end of each thread to a predetermined distance from the splicing device, vibrating, loosening, combing and separating the thread ends into individual fibers, cleaning and spreading apart each thread end by blowing compressed air into the splicing device obliquely to the longitudinal direction of the individual fibers and by beating, pulling and tearing with mechanical and pneumatic stresses in direction toward the thread ends, withdrawing the prepared thread ends from opposite sides up to the splicing device, tangling, mixing and hooking the individual fibers of the two thread ends to each other to form a splice connecting the threads after setting the splicing device in operation, introducing a thread twist into the splice, and removing the connected threads from the splicing device.

In order to provide an apparatus for carrying out the method, there is provided a device for performing a knot-free connection of the ends of two threads formed of textile fibers of limited length having at least one twisted fiber strand, comprising a splicing device for mutually tangling, intermixing and intertwining individual fibers of the two threads, two thread end preparation units each being disposed in vicinity of the splicing device for a respective thread end, each of the thread end preparation units including a mostly pneumatically acting part and a mostly mechanically acting part, each of the mostly pneumatically acting parts having a longitudinal slot formed therein for holding and guiding a thread, and at least one compressed gas supply channel terminating in each respective slot across the thread end, and each of the mostly mechanically acting parts having at least one contact surface being movable in direction toward the thread end contacting the fibers, at least part of the compressed gas from the respective mostly pneumatically acting part flowing over the contact surfaces.

In accordance with another feature of the invention, the supply channels are oriented obliquely to the thread ends.

In accordance with a further feature of the invention, the mostly mechanically acting parts each include a turbine rotor being activatable from outside and being driven by compressed gas.

In accordance with an added feature of the invention, the contact surfaces are in the form of uneven gripping surfaces on the periphery of the rotors.

In accordance with an additional feature of the invention, the turbine rotors are in the form of grinding wheels with respect to the material composition and shape thereof.

In accordance with again another feature of the invention, the turbine rotors each include an outer ring of gear-type teeth and a coating formed of a granular grinding agent disposed on the teeth.

In accordance with again a further feature of the invention, the turbine rotors are rotated by exposure to a radially-directed flow of compressed gas.

In accordance with again an added feature of the invention, the turbine rotors are disposed laterally along the longitudinal slots formed in the mostly pneumatically acting parts, and including a nozzle disposed at each of the longitudinal slots opposite each of the compressed gas supply channels for rotating the turbine rotors with a directed jet of compressed gas from a stream of compressed gas also supplying the longitudinal slots.

In accordance with again an additional feature of the invention, the turbine rotors are disposed downstream of the longitudinal slots formed in the mostly pneumatically acting parts, and the turbine rotors are rotated by a directed jet of compressed gas coming from the longitudinal slots.

In accordance with yet another feature of the invention, the turbine rotors are disposed along an imaginary line extended through the longitudinal slots.

In accordance with yet a further feature of the invention, there is provided a controllable thread holder and at least one common controllable thread withdrawal device disposed in vicinity of the splicing device.

In accordance with yet an added feature of the invention, the threads have a normal thread path, and the longitudinal slots formed in the mostly pneumatically acting parts are disposed outside the normal thread path and are directed against the splicing device at an acute angle to the normal thread path.

In accordance with yet an additional feature of the invention, the splicing device includes a splicing chamber being activatable by compressed gas splicing, the splicing chamber having a longitudinal slot formed therein in alignment with the longitudinal slots formed in the mostly pneumatically acting parts for holding and guiding the threads.

In accordance with a concomitant feature of the invention, the threads have a given path during splicing, and the controllable thread withdrawal device includes a lever at least surrounding the splicing device and having two arms being pivotable across the given thread path.

Before explaining the embodiments of the invention in detail, the advantages of the invention will be explained more explicitly.

The conditions for a good splice connection are met if the fiber strands of the threads are disentangled down to their individual fibers, if the thread ends are thereby spread apart so that if possible the individual fibers lie with spaces between each other, and finally if dirt particles, dust and short fibers are cleaned off from the thread endings. Thread ends prepared in this manner can then be connected by different splicing methods. These include known electrostatic splicing methods, as well as compressed air or compressed gas splicing methods.

The method according to the invention relates to the complete splicing operation, although the greatest importance is placed on the preparation of the thread endings. The term thread ending in this connection refers to that region of the thread length which extends back from the outermost end of the thread as far as the length of the individual fibers.

If the two threads, which may also consist of several individually twisted fiber strands, are placed into the splicing device coming from opposite sides, each thread end is trimmed to a predetermined distance from the splicing device (in this case the end of each thread is being referred to). This can be done by using a controllable cutting device, a grinding wheel, or a grinding disc-type turbine rotor which will be discussed below. This operation achieves the advantageous result of the two thread ends first of all having the same length with respect to the splicing device, so that later on a symmetrical splice can be formed.

Thereafter, the thread endings receive a special treatment. By using compressed gas, which flows in obliquely to the longitudinal direction of the individual fibers with a beating and simultaneous rubbing, tearing and pulling mechanical and pneumatic action, the thread endings are caused to vibrate, are loosened, combed, disentangled down to individual fibers, cleaned and spread apart. The combined action of pneumatic and mechanical stress is especially advantageous in the preparation of the thread ends. Both actions complement each other. This result is not merely the sum of individual actions. A surprising effect which occurs is that the individual fibers of the spread thread endings remain in the spread-apart state until later when the actual splicing takes place. This can be explained by the fact that the thread ends become electrostatically charged by the combined mechanical and pneumatic stresses.

The prepared thread endings are then withdrawn up to the splicing device on opposite sides. Thereafter, the splicing device can be started, so that the individual fibers of both thread endings are entangled with each other, intermixed and hooked together. Finally, a twist is given to the thread at the splicing region, which in the simplest case is accomplished by opening the previously closed thread holders. In this case, the held-back twist behind the thread holders travels into the splice region which generally has no twist in it. Finally, the threads which now also have a twist at the splice region, are removed from the splicing device.

If the splicing device operates with compressed gas to make the actual splice, the splicing device is generally made of metal. Since the individual fibers do not only come in contact with each other, but also with the metallic parts of the splicing device during the splicing operation this results in possibly still existing electrostatic charges being conducted away, so that the fibers no longer have the tendency to be spread apart.

A thread end preparation unit is provided for each thread ending in the vicinity of the splicing device. The preparation unit includes a mostly pneumatically acting part, and a mostly mechanically acting part. The mostly pneumatically acting part has a longitudinal slot which holds and guides the thread, into which at least one supply channel for the compressed gas terminates across or obliquely with respect to the thread end. The mostly mechanically acting part is provided with at least one contact surface which can move toward the end of the thread. In this case, the most outward end of the thread is being referred to. This contact surface is in contact with the fibers, and is exposed to the flow of the compressed gas which comes from the mostly pneumatically acting part. The compressed gas is therefore also effective in an advantageous way for preparing the thread ending after it has left the longitudinal slot. It is helpful, if the mostly mechanically acting part is provided with a turbine rotor which can be activated from the outside and can be driven by compressed gas. The compressed gas is available anyway in such machines, and such a turbine rotor can be effectively constructed in a simple way. A special drive mechanism is therefore not required.

The turbine rotor is provided with gripping surface roughnesses on its outer periphery, which serve as contact surfaces in an advantageous embodiment. These uneven rough surfaces have a two-fold purpose. Firstly, they are meant to grip and stress the fibers of the thread ends, and secondly these uneven surfaces form points of application for the compressed gas which drives the turbine rotor. In this way, the compressed gas stream also takes along the fibers or the thread ends, respectively, and throws them against the turbine rotor. These uneven surfaces may relate merely to a more or less granular surface. For example, the turbine rotor can be made in the form of a grinding wheel, with respect to its material composition and shape. In a grinding wheel, granular particles of corundum or another material are provided, and are connected to each other to form a rough gripping surface. Furthermore, the turbine rotor can advantageously be provided with axially oriented uneven projections. These may be axially directed low or high spots. Bars, splines or grooves are being referred to in this context. It is especially advantageous, with respect to the successful disentanglement of the fibers and also with respect to the drive, if the turbine rotor is provided with an outer tooth ring, like a gear, the teeth of which are coated with a granular grinding agent. For example, these grinding agents may be corundum grains. It is desirable for the grinding agent to have the greatest possible wear-resistance. The grinding agent should not wear rapidly by contact with the threads and the fibers.

It is advantageous if the turbine rotor is directly exposed to the flow of the compressed gas jet, and thereby caused to rotate. Some constructions are more effective for this purpose than others. The turbine rotor can be disposed alongside the longitudinal slot of the mostly pneumatically acting part of the thread preparation unit. In this case, the directed compressed gas jet is generated by a nozzle, which is located opposite the gas supply channel, and is fed by the same compressed gas stream which also supplies the longitudinal slot. The orientation of this nozzle also determines the position of the turbine rotor. However, the direction of the nozzle also at least approximately determines the direction of the gas supply channel for the compressed gas. Every time, if a compressed gas jet is applied to the longitudinal slot, a part of this gas flow is also applied to the nozzle, so that the turbine rotor is caused to rotate.

According to another preferred embodiment, the turbine rotor is disposed in the continuation of the longitudinal slot behind or downstream of the mostly pneumatic part of the thread end preparation unit, and the directed jet of compressed gas is the compressed gas stream leaving the longitudinal slot. In this case, the compressed jet flow is generally not as intensive as in the preceding embodiment, but this can be compensated for by providing the turbine rotor with larger working surfaces for the gas to act on, such as a kind of paddle wheel.

It is advantageous if the turbine rotor is surrounded by a gas-guiding wall at least over a part of its periphery. By adjusting the distance between the gas guide wall and the turbine rotor, the intensity of the mechanical stresses can be controlled.

The intensity of the electrostatic charge can also be controlled by the gas guiding wall, through the choice of the material for this wall. A higher charge can be expected from a gas-guiding wall made of an insulating material.

All of the supply channels for the compressed gas of the two thread end preparation units are advantageously connected to a common gas-metering valve for the compressed gas. In this manner, the simultaneous operation of the units is assured. Furthermore, there is only one gas-metering valve required.

The prepared thread endings have to be moved from the preparation units into the splicing device to make the actual aplice. For this purpose, it is proposed to provide a controllable thread holder and a controllable thread withdrawal device for each of the threads which are to be joined. The thread holder only clamps the thread to hold the thread fixed, while to thread withdrawal device retracts the thread ending until it lies in the splicing device.

A controllable thread withdrawal device is advantageously formed of a two-armed lever which surrounds at least the splicing device, while the lever arms cross the thread path as they perform their swinging motion. This motion may lie directly near the splicing device, for example. However, it can also be located further away from the splicing device, so that it lies nearer to the thread holders. Because of the feature of the lever arms crossing the thread path, they take along the threads by forming a thread loop. The thread endings are thus guided in the longitudinal slots.

It is advantageous if the longitudinal slots of the preparation units which hold and guide the respective thread are disposed outside of the normal thread path, so that they are directed at an acute angle relative to the normal thread path toward the splicing device. This is advantageous with respect to locating the individual parts, and also with respect to handling the threads, because in this case, the two threads are spaced apart from each other outside the splicing chamber.

If the splicing device is operated with compressed gas for compressed gas splicing, it is advantageous to also provide an additional longitudinal thread holding and guiding slot, which in this case should be in line with the longitudinal slots of the thread end preparation units. This also facilitates the insertion of the threads which are to be joined. Finally, to improve the electrostatic charging of the thread ends, it is additionally proposed to form at least the movable contact surfaces of the mechanically acting part of the thread end preparation unit and/or the parts which carry these contact surfaces, of an electrically insulating material. Obviously, in the simplest case the whole turbine rotor can be made of an electric-insulating material. The same also applies for its coating.

The turbine rotors should be freely rotatable. For this purpose, encapsulated or shielded roller bearings are well suited. However, the turbine rollers should not be completely encapsulated, so that there can be a self-cleaning effect. It must be made certain that there is a place provided where the compressed gas stream, which is loaded with dirt particles and short fibers, can freely escape. As a rule, compressed air is used as the compressed gas medium. However, it is not inconceivable for some special fiber materials and special threads, for a special compressed gas mixture to be advantageous. For example, dust-free compressed gas, compressed gas with an atomized fluid or with a component of atomized textile adjuvants or corrosion protection means may be used.

To make it possible to join different threads with different fiber lengths in one and the same device, it is advantageous to place the thread end preparation units in an adjustable position with respect to their distance from the splicing device. By the use of this feature, it is possible to set the length of the thread ending which is to be prepared for treatment.

Other features which are considered as characteristic for the invention are set forth in the appended claims.

Although the invention is illustrated and described herein as embodied in a method and device for the knot-free connection of two threads, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 2 is a top plan view of FIG. 1;

FIG. 3 is a fragmentary detailed view of the thread holder or clamp of FIG. 1;

FIG. 7 is a fragmentary, front elevational view, partly broken away, of the preparation unit in an advanced state of preparing the thread endings;

FIGS. 8 and 9 are fragmentary, cross-sectional views showing further details of the preparation unit;

Figure 1:
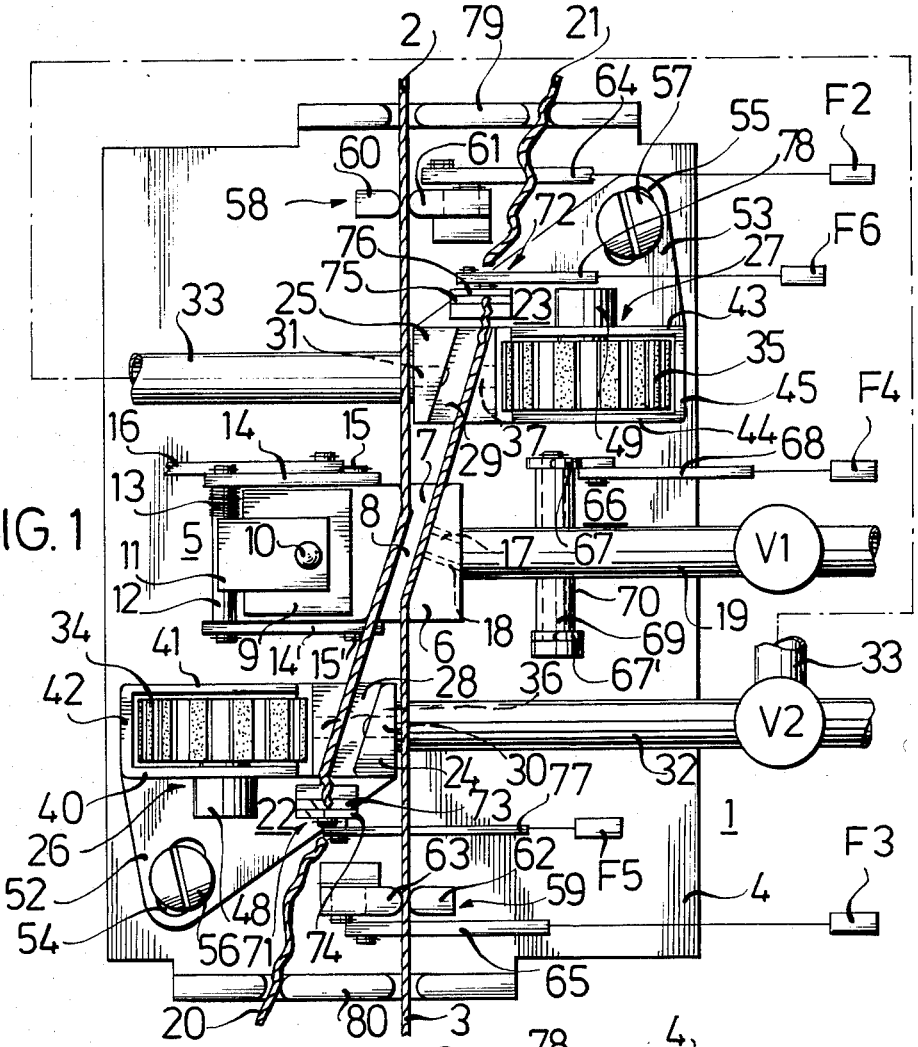
FIG. 1 is a fragmentary, diagrammatic, front elevational view of a first embodiment of the invention.
Figure 4:
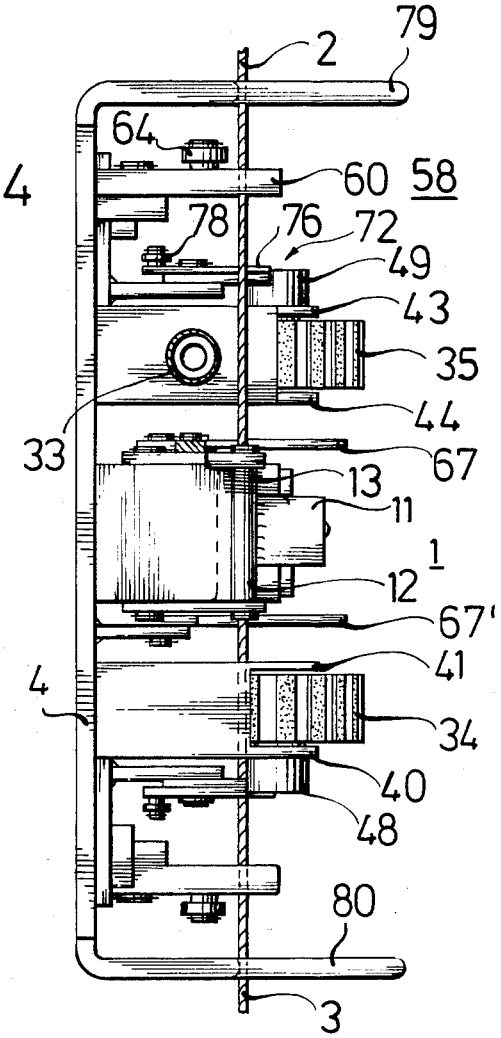
FIG. 4 is a side elevational view of the embodiment of FIG. 1.

Referring now to the figures of the drawing and first, particularly, to FIG. 1 thereof, it is seen that in the first embodiment, a device for the knot-free joining of two threads 2, 3 consisting of textile fibers of limited length, is designated as a whole with reference numeral 1. The thread joining device has a base plate 4 on which the other parts thereof to be mentioned later, are fastened.

Disposed on the base plate 4 is a splicing device 5, which includes a splicing chamber 6 that can be operated by pressurized gas. The splicing chamber 6 has a longitudinal slot 7 formed therein which holds and guides the threads 2, 3.

The normal path of the thread in this case is vertical from the bottom upward. The longitudinal slot 7 crosses this normal path of the thread at an acute angle at a point 8.

The longitudinal slot 7 of the splicing chamber 6 can be closed by a cover 9. For this purpose, the cover 9 is provided with a ball joint 10 which is supported at a lever 11. The lever 11 is fastened to a pivot pin 12, and is loaded by a wound coil spring 13. Under the action of the spring 13, the cover 9 always lies on the surface of the splicing chamber 6. The pivot pin 12 is held by a two-armed lever 14, 14', which is hinged to rotate at joints 15, 15'. The hinge joints are located within the splicing chamber 6. A lever 16 is connected to the lever 14 to provide for its mechanical operation, the lever 16 being movable in its longitudinal direction by an operating device F1 shown in FIG. 2.

In order to carry out the splicing with pressurized gas, the splicing chamber 6 is provided with two channels 17 and 18 for the pressurized gas. The two gas channels are supplied with compressed gas through a line 19 with the aid of a gas metering valve V1, from a compressed gas source which is not shown in the drawing.

The thread 3 enters into the embodiment of the device shown in the drawing from a run-off spool which is also not shown, and the thread 2 is taken up by a non-illustrated take-up spool. A thread break is to be repaired by connecting the two threads with each other. Due to the thread break, the thread 2 has an outgoing leading thread ending 20 and thread 3 has a leading thread end 21.

A thread end preparation unit 22 for preparing the end of the thread 2 is disposed in vicinity of the splicing device 6. In the same manner, a thread end preparation unit 23 for preparing the end of the thread 3 is disposed in vicinity of the splicing chamber 6. Each thread end preparation unit is formed of one part which is mainly pneumatically activated, and another part which operates mainly by mechanical means. At the thread end preparation unit 22, the mostly pneumatic part is designated with reference numeral 24, and the mostly mechanical part is designated with reference numeral 26. At the thread end preparation unit 23, the mostly pneumatic part is designated with reference numeral 25, and the mostly mechanical part with reference numeral 27. The part 24 has a longitudinal slot 28 formed therein which holds and guides the thread 2, and the part 25 has a longitudinal slot 29 formed therein which holds and guides the thread 3.

The longitudinal slot 28 which holds and guides the thread 2, is located outside of the normal thread path, so that it is directed at an acute angle with respect to the normal thread path, toward the splicing device 5. In the same manner, the longitudinal slot 29 which holds and guides thread 3 is also located outside of the normal thread path, so that it is directed at an acute angle to the normal thread path toward the splicing device 5. Furthermore, all three longitudinal slots 28, 7 and 29 lie along a straight line.

A compressed air supply channel 30 terminates in the longitudinal slot 28 along a direction which is obliquely across the thread end, and a compressed air supply channel 31 also terminates crosswise and obliquely in the longitudinal slot 29. The gas supply channel 30 is connected by a line 32 to a compressed gas metering valve V2. The compressed air channel 31 is connected by a line 33 to the same compressed gas metering valve V2, as diagrammatically illustrated by a dot-dash line. By means of the compressed gas metering valve V2, the gas supply channels 30 and 31 can be controlled, and can be connected to a non-illustrated compressed gas source for a limited time.

The mostly mechanical part 26 of the thread end preparation unit 22 is provided with a turbine rotor 34, which is activated from the outside and can be driven by compressed gas. In the same manner, the part 27 has a turbine rotor 35, which also is activated from the outside and can be driven by compressed gas.

The turbine rotors 34, 35 in each case are activated by a radially directed gas flow, and thereby set in rotation. This happens only during the time span required for the preparation of the thread endings which will be described later on.

The turbine rotors are disposed at the sides adjacent the longitudinal slots of the pneumatically operating parts of the thread end preparation units. The directed stream of compressed gas which causes the turbine rotor 34 to rotate is therefore generated by a nozzle 36, which is located opposite the compressed gas channel 30, and is supplied by the same gas current which also feeds the longitudinal slot 28. In the same manner, the directed compressed gas jet which rotates the turbine rotor is generated by a nozzle 37, which is located opposite the gas supply channel 31, and is fed by the same compressed gas current which also feeds the longitudinal slot 29.

The two turbine rotors 34 and 35 are made like grinding wheels with respect to their composition and shape. However, they are grinding wheels of a special kind. The turbine rotors have axially-directed projections in the form of teeth 28 like a gear, as shown in FIG. 2. The teeth 38 form a complete outer tooth ring 39, and are coated with a granular grinding medium. The outer tooth rings are each formed of a duro-plastic electrial insulating material. The coating is formed of corundum particles which are cemented in place.

Figure 6:
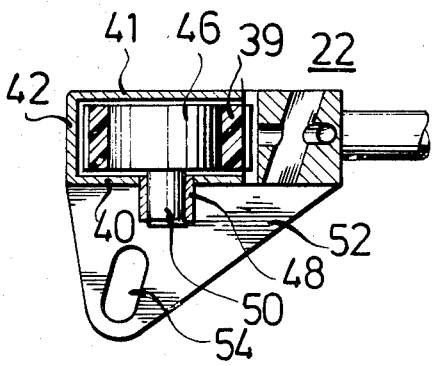
FIGS. 5 and 6 are cross-sectional views showing details of a preparation unit.
Figure 5:
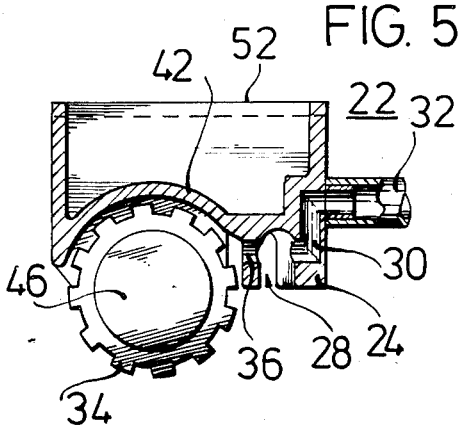
Figure 10:
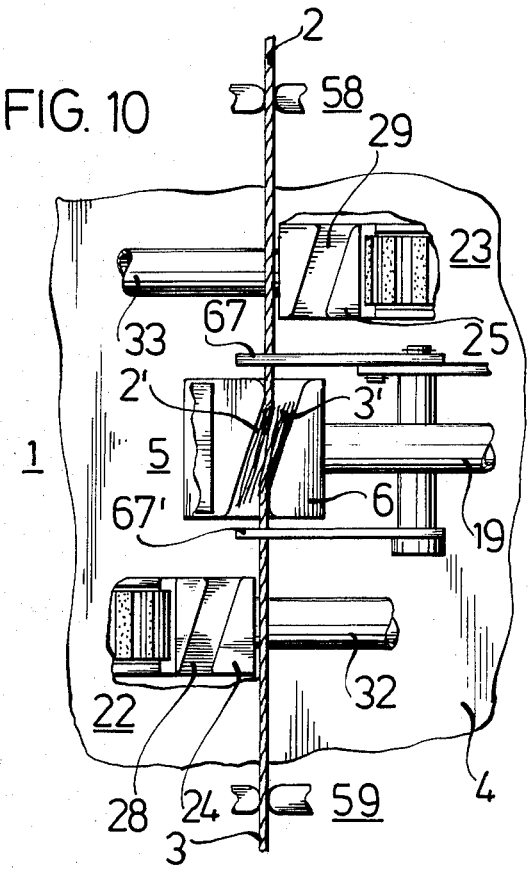
FIG. 10 is a fragmentary view of the same device shortly before the actual joining of the two thread endings.

The turbine rotor 34 is surrounded at the sides thereof by guide walls 40, 41 for the compressed gas, and is also enclosed over part of the circumference thereof by a curved guide wall 42 for the gas. As shown in FIG. 6, a short tube 48 in the gas guide wall 40 supports a short axle journal 50 on which a completely enclosed roller bearing 46 is mounted. The tooth ring 39 sits on this roller bearing 46. To assure that the unit is adjustable, the thread end preparation unit 22 is provided with a foot 52 having an elongated hole 54 through which a screw 56 is inserted as seen in FIG. 1, so that the thread end preparation unit 22 is adjustably secured to the base plate 4.

In the vicinity of the splicing device 5, a controllable thread holder and a controllable thread withdrawal device are provided for each of the threads 2, 3 which are to be connected with each other. The controllable thread holder or clamp 58 for the thread 2 is somewhat more clearly shown in FIG. 3. The holder is formed of a fixed clamping member 60 and a movable hinged clamping member 61. A pivotably lever 64 which is attached to the movable clamping member 61 is moved to and fro along the longitudinal direction thereof by an operating device F2. FIG. 1 shows that the thread holder 58 is closed at a given instant and holds the thread 2 in a fixed position.

In the same manner, the thread holder 59 for the thread 3 is formed of a fixed clamping manner 62 and a movable clamping member 63. The movable clamping member 63 can be moved by a lever 65, which is connected to an operating device F3. The lever 65 can be moved to and fro along the direction of its longitudinal axis by the operating device F3. FIG. 1 shows the thread holder 59 in its closed position, in which the thread 3 is held in a fixed position.

A common controllable thread withdrawal device 66 is provided for both threads 2, 3. The thread withdrawal device 66 is formed of a two-armed lever 67, 67' which extends to both sides of the splicing device 5. The lever 67, 67' is hingeably connected to an operating rod 68. The lever sits on a shaft 69, which is supported in a sleeve 70 that is connected to the base plate. The operating rod 68 is connected to an operating device F4. With the aid of the operating device F4, the operating rod 68 can be moved to and fro. FIG. 1 shows that the thread withdrawal device 66 is in the normal position.

FIG. 1 also illustrates that there are thread cutting devices at the continuation of the longitudinal slots 28 and 29. A thread cutting device 71 is disposed in front of the longitudinal slot 28, and another thread cutting device 72 is disposed in front of the longitudinal slot 29. The thread cutting device 71 is formed of a fixed knife 73 which is connected to the base plate, and a movable knife 74 which is hingeably attached to a bar 77 that is connected to an operating device F5. The bar 77 can be mocved to and fro along its longitudinal direction by the operating device F5. FIG. 1 shows the thread cutting device 71 in the closed state, in which the forward thread end 20 of the thread has just been severed.

In the same manner, the thread cutting device 72 is formed of a fixed knife 75 connected to the base plate and a movable knife 76, which is hingeably attached to a bar 78. The bar 78' is connected to an operating device F6. The bar 78 can be moved to and fro along its longitudinal direction by an operating device F6. FIG. 1 shows an operating state in which the thread cutting device has just closed, and has already severed the forward thread end 21 of thread 3.

To facilitate the insertion of the thread at the upper end of the base plate 4, a threading aid 79 is provided. Similarly, at the lower end there is a threading aid 80. Each threading aid is formed of a wall into which V-shaped slits are machined.

For splicing, both threads coming from opposite sides are first inserted into the splicing device 5. Therefore, the upper thread 2 lies in the open thread holder 58, in the longitudinal slot 7, in the longitudinal slot 28 and in the open thread cutting device 71. The lower thread 3 coming from the bottom lies in the open thread holder 59, in the longitudinal slot 7, in the longitudinal slot 29 and in the open thread cutting device 72.

By operating both thread cutting devices, the ends of both threads are trimmed to a predetermined distance from the splicing device 5. FIG. 1 shows the apparatus in this state. Both leading thread endings 20 and 21 are to be removed. This can be achieved by suction, for example. Thereafter, the preparation of the newly generated thread endings for splicing begins. For this purpose, the gas metering valve V2 is placed in operation, so that the compressed gas flows through the two supply channels 30, 31 and toward the two nozzles 36 and 37. In this way, a part of the compressed gas flow is deflected and escapes through the two longitudinal slots 28 and 29. However, a part of the compressed gas stream flows through the two nozzles, and thereby carries along the thread ends 2', 3', respectively, as shown in FIG. 7. Simultaneously, the two turbine rotors 34 and 35 also start to rotate.

FIGS. 8 and 9 of the drawing illustrate what happens in this operation, with the thread ending 2', for example. The stream of compressed gas flows from the gas supply channel 30, across the longitudinal channel 28, and thereby carries the thread ending 2' through the nozzle 36 in the direction toward the turbine rotor 34. The thread ending 2' is thus pneumatically stressed, first in the longitudinal channel 28, then in the nozzle 36 and finally in the annular space between the tooth ring 38 and the curved gas guiding wall 42. Additionally, the thread ending 2' comes into mechanical contact with contact surfaces 81 on the teeth 38 of the tooth ring 39. These contact surfaces are formed of corundum particles, and are therefore very rough. The compressed glas flows obliquely with respect to the longitudinal direction of the individual fibers so that pneumatic stresses are applied to the thread ending and its fibers, which are simultaneously combined with a beating, pulling and ripping mechanical action in the direction toward the end of the thread. Because of these actions, the thread end is loosened, combed and dissolved down to its individual fibers, and cleaned and spread apart as shown diagrammatically in FIG. 9. Dirt particles and short fibers which do not contribute to the strength of the thread connection are blown away during this operation.

Figure 13:
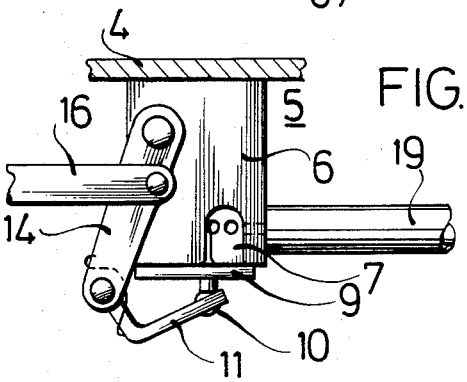

After the compressed gas is allowed to flow for a short time, the gas metering valve V2 is closed again, and the thread withdrawal device 66 is set in operation by the operating device F4. The two-armed lever 67, 67' of the thread withdrawal device 66 now moves into the thread withdrawal position shown in FIGS. 10 to 13. In this way, the thread endings 2' and 3' are pulled back so far that they lie side by side in the longitudinal slot 7 of the splicing chamber 6. The cover 9 is then pushed over the slot 7 of the splicing chamber 6 by the operating device F1, as shown in FIG. 13.

Figure 11:
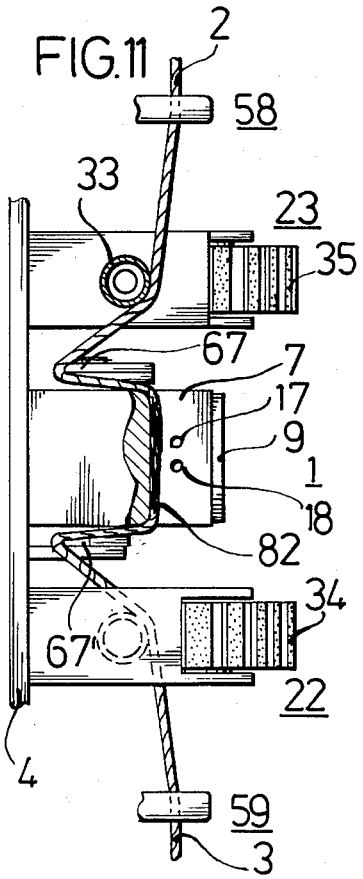
FIG. 11 is a side elevational view of FIG. 10.
Figure 12:
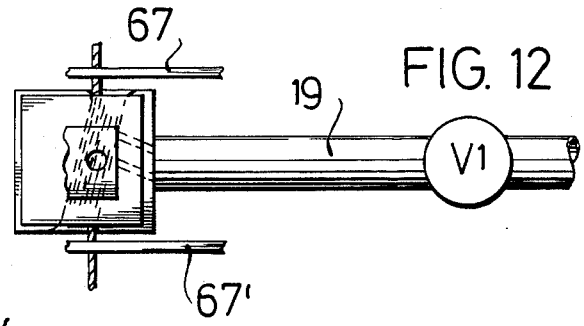
FIGS. 12 and 13 are fragmentary views showing further details of this operating state.

If the metering valve V1 for the compressed gas is subsequently opened, the gas flows from the side into the longitudinal slot 7, whereby the individual fibers of the two thread ends are intermingled with each other and hooked to each other, so that a spliced connection is formed. The two-armed lever 67, 67' of the thread withdrawal device 66 then swings back again to the start position, the two thread holders 58 and 59 are opened, so that the thread twist which has been held back can advance to the newly formed splice 82, as shown in FIG. 11. If the non-illustrated take up spool begins to pull again, the joined thread rapidly moves forward out of the splicing device, and the splicing device is again ready to produce a new knot-free connection. For example, the device can be moved to a different work station.

Figure 14:
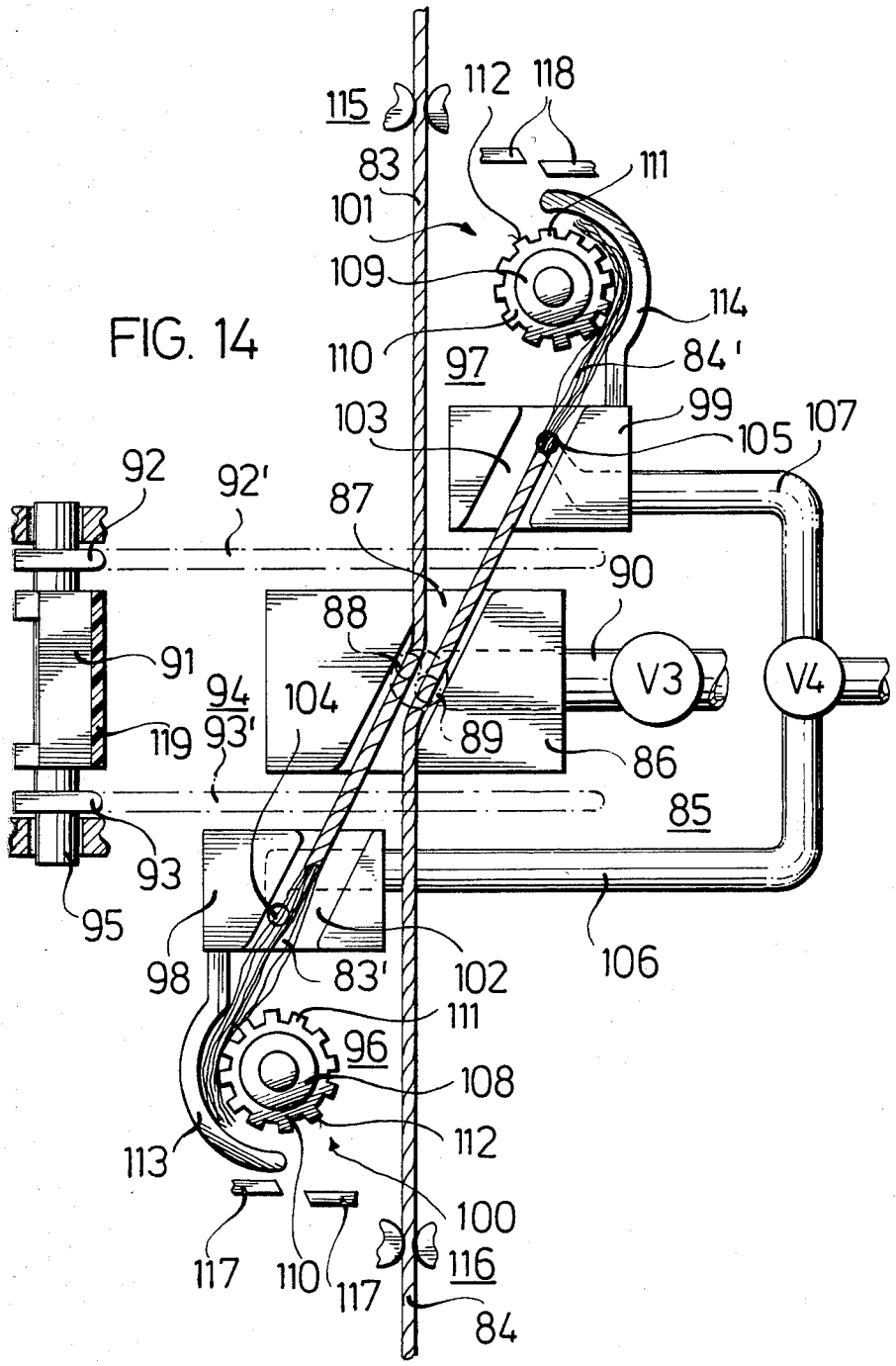
FIG. 14 is a fragmentary, diagrammatic, elevational view of another typical embodiment of the device.

FIG. 14 shows a very simplified diagrammatic representation of a second typical embodiment of the invention. The splicing device for the knot-free connection of two threads 83 and 84 is designated in this case with reference numeral 85. A splicing chamber 86 of the splicing device 85 and the parts associated with the splicing chamber are constructed and disposed as shown in the first embodiment. FIG. 14 indicates that a longitudinal slot 87, which holds and guides the threads to be connected with each other, and which later serves for forming the splice connection, crosses the normal thread path which runs from the botton upward, at an acute angle. Two channels 88 and 89 for the compresses gas, terminate from below in the longitudinal slot 87. The channels 88, 89 are fed through a line 90, which is connected through a gas metering valve V3 to a source for compressed gas, that is not shown in the figure. A cover 91 for closing the longitudinal slot 87 during the splicing operation, is attached to a common pivot axis 95, together with the thread withdrawal device 94 which is formed of two lever arms 92 and 93. A thread preparation unit 96, 97, respectively, for each thread ending 83', 84', respectively, is disposed in vicinity of the splicing device 94. Each thread preparation unit includes a mostly pneumatically acting part, and a mostly mechanically acting part. The mostly pneumatic part of the thread preparation unit 96 is designated with reference numeral 98, and the mostly mechanical part with reference numeral 100. The mostly pneumatic part of the thread end preparation unit 97 is designated with reference numeral 99, and the mostly mechanical part with reference numeral 101.

The mostly pneumatically acting part 98 in this embodiment also has a longitudinal slot 102 holding and guiding the thread 83. The slot is located outside the normal thread path in such a manner that it is directed at an acute angle relative to the normal thread path, against the splicing device 94. In the same manner, the longitudinal slot 103 of the part 99 is directed at an acute angle relative to the normal thread path against the splicing device 94. A gas supply channel 104 for the compressed gas terminates in the slot 102 crosswise and obliquely relative to the thread wnding 83'. In the same manner, a supply channel 105 for the compressed gas terminates in the slot 103 crosswise and obliquely relative to the thread ending 84'. The supply channel 104 for the compressed gas is connected to a line 106, and the supply channel 105 is connected to a line 107. The lines 106 and 107 lead to a gas metering valve V4 which is connected to a source for compressed gas that is not shown in the figure.

The mostly mechanically acting part 100 is provided with a turbine rotor 108 which is driven by compressed gas, and the mostly mechanically acting part 101 has a turbine rotor 109. Each turbine rotor has an outer tooth ring 110 in the form of a gear, with teeth 111 which are coated with a granular abrasive. The teeth therefore form individual contact surfaces 112 which are in contact with the fibers of the thread endings.

The turbine rotor 108 is disposed in the continuation of the longitudinal slot 102 downstream of the mostly pneumatically acting part 98 of the thread end preparation unit 96. In the same manner, the turbine rotor 109 is disposed in the continuation of the longitudinal slot 103 downstream of the mostly pneumatically acting part 99. The turbine rotor 108 is surrounded by a wall 113 for guiding the gas flow over part of its circumference. In the same manner, the turbine rotor 109 is surrounded by a gas guiding wall 114 over part of its circumference.

In the vicinity of the splicing device 85, a controllable thread holder 115, 116, respectively, is provided for each of the threads 83, 84 which are to be connected with each other, as well as the already mentioned controllable thread withdrawal device 94. The two lever arms 92 and 93 of the thread withdrawal device 94 are therefore nearer the splicing device 85 than the two controllable thread holders 115 and 116.

A thread cutting device 117 is disposed adjacent the thread end preparation unit 96, and a thread cutting device 118 is adjacent the thread end preparation unit 97.

The function of the device according to FIG. 14 relates to the device according to the first embodiment of the invention. The figure shows the end phase in the preparation of the thread endings. Compressed gas flows through the open gas metering valve V4 into the two compressed gas supply channels 104 and 105, the terminations of which are obliquely directed toward the thread ends and against the direction of twist of the thread. The compressed gas flows through the two longitudinal slots 102 and 103, mainly toward the gap between the turbine rotors 108, 109, and the gas guiding walls 113, 114, respectively. The turbine rotors therefore start to turn, and act mechanically on the thread endings which have already been partly disentangled down to individual fibers in the two longitudinal slots. The slots 102 and 103 are dimensioned in such a way that the two threads have enough space to be pounded back and forth under the influence of the pneumatic and mechanical forces.

After closing the gas valve V4, and before the gas metering valve V3 is opened, the pivot axis 95 is rotated, so that the two lever arms 92 and 93 cross the thread path and are placed into the position 92', 93', respectively, which is shown with dot-dash lines. Simultaneously, the cover 91 swings toward the splicing chamber 86, and completely covers the longitudinal slot 87 with a sealing lining 119. The finish splicing operation is performed in the manner already described for the first embodiment.

The invention is not limited to the illustrated and described typical embodiments. For example, it is possible to align all three longitudinal slots, while orienting this line vertically, and to correspondingly move the normal thread path from the vertical direction. Separate thread cutting devices can be omitted, if the thread cutting function is taken over by the mechanically active parts of the thread end preparation unit. This is possible since after the individual fibers have been loosened to a certain degree, it is already sufficient to pull at the existing thread end in order to achieve a complete separation and obtain a new thread ending.

We claim:

1. Method for the knot-free connection of two threads formed of textile fibers of limited length having at least one twisted fiber strand, including a splicing device for mutually tangling, intermixing and intertwining individual fibers of the two threads, which comprises inserting the two threads coming from opposite sides into the splicing device, trimming the end of each thread to a predetermined distance from the splicing device, vibrating, loosening, combing and separating the thread ends into individual fibers, cleaning and spreading apart each thread end by blowing compressed air into the splicing device obliquely to the longitudinal direction of the individual fibers and by beating, pulling and tearing with mechanical and pneumatic stresses in direction toward the thread ends, withdrawing the prepared thread ends from opposite sides up to the splicing device, tangling, mixing and hooking the individual fibers of the two thread ends to each other to form a splice connecting the threads after setting the splicing device in operation, introducing a thread twist into the splice, and removing the connected threads from the splicing device.

2. Device for performing a knot-free connection of the ends of two threads formed of textile fibers of limited length having at least one twisted fiber strand, comprising a splicing device for receiving the two threads coming from opposite sides into said splicing device and for mutually tangling, intermixing and intertwining individual fibers of the two threads, means for trimming the end of each thread to a predetermined distance from said splicing device, two thread end preparation units each being disposed in vicinity of said splicing device for vibrating, loosening, combing and separating each respective thread end into individual fibers, each of said thread end preparation units including a mostly pneumatically acting part and a mostly mechanically acting part, each of said mostly pneumatically acting parts having a longitudinal slot formed therein for holding and guiding a thread, at least one compressed gas supply channel terminating in each respective slot across the thread end, and each of said mostly mechanically acting parts having at least one contact surface being movable in direction toward the thread and contacting the fibers, means for directing at least part of the compressed gas from said respective mostly pneumatically acting part over said contact surfaces for beating, pulling and tearing with mechanical and pneumatic stresses in direction toward the thread ends, means for withdrawing the prepared thread ends from opposite sides up to said splicing device, a compressed gas line blowing compressed gas into said splicing device obliquely to the longitudinal direction of the individual fibers for cleaning and spreading apart each thread end and for tangling, mixing and hooking the individual fibers of the two threads to each other to form a splice connecting the threads after setting said splicing device in operation, means for introducing a thread twist into the splice, and means for releasing the connected threads from said splicing device.

3. Device according to claim 2, wherein said supply channels are oriented obliquely to the thread ends.

4. Device according to claim 2, wherein said mostly mechanically acting parts each include a turbine rotor being driven by compressed gas impinging upon an outer surface of each rotor from said directing means.

5. Device according to claim 4, wherein said contact surfaces are in the form of uneven gripping surfaces on the periphery of said rotors.

6. Device according to claim 4, wherein said turbine rotors are in the form of grinding wheels with respect to the material composition and shape thereof.

7. Device according to claim 4, wherein said turbine rotors each include an outer ring of gear-type teeth and a coating formed of a granular grinding agent disposed on said teeth.

8. Device according to claim 4 wherein said turbine rotors are rotated by exposure to a radially-directed flow of compressed gas from said directing means.

9. Device according to claim 8, wherein said turbine rotors are disposed laterally along said longitudinal slots formed in said mostly pneumatically acting parts, and including a nozzle disposed at each of said longitudinal slots opposite each of said compressed gas supply channels for rotating said turbine rotors with a directed jet of compressed gas from a stream of compressed gas also supplying said longitudinal slots.

10. Device according to claim 8, wherein said turbine rotors are disposed downstream of said longitudinal slots formed in said mostly pneumatically acting parts, and said turbine rotors are rotated by a directed jet of compressed gas coming from said longitudinal slots.

11. Device according to claim 10, wherein said turbine rotors are disposed along an imaginary line extended through said longitudinal slots.

12. Device according to claim 2, including a controllable thread holder and at least one common controllable thread withdrawal device disposed in vicinity of said splicing device.

13. Device according to claim 2, wherein the threads have a normal thread path, and said longitudinal slots formed in said mostly pneumatically acting parts are disposed outside the normal thread path and are directed against said splicing device at an acute angle to the normal thread path.

14. Device according to claim 13, wherein said splicing device includes a splicing chamber being activatable by compressed gas for compressed gas splicing, said splicing chamber having a longitudinal slot formed therein in alignment with said longitudinal slots formed in said mostly pneumatically acting parts for holding and guiding the threads.

15. Device according to claim 12, wherein the threads have a given path during splicing, and said controllable thread withdrawal device includes a lever at least surrounding said splicing device and having two arms being pivotable across said given thread path.

* * * * *